US007562918B2

(12) United States Patent
Toma et al.

(10) Patent No.: US 7,562,918 B2
(45) Date of Patent: Jul. 21, 2009

(54) LOCKING/UNLOCKING DEVICE FOR A DOOR OPENER SWIVEL LATCH

(75) Inventors: Augustin Toma, Balingen (DE); Norman Wittke, Albstadt (DE)

(73) Assignee: Assa Abloy Sicherheitstechnik Gmbh, Albstadt (DE)

( * ) Notice: Subject to any disclaimer, the term of this patent is extended or adjusted under 35 U.S.C. 154(b) by 124 days.

(21) Appl. No.: 10/522,581

(22) PCT Filed: Sep. 15, 2004

(86) PCT No.: PCT/EP2004/010355

§ 371 (c)(1),
(2), (4) Date: Sep. 23, 2005

(87) PCT Pub. No.: WO2005/080718

PCT Pub. Date: Sep. 1, 2005

(65) Prior Publication Data

US 2006/0097525 A1 May 11, 2006

(30) Foreign Application Priority Data

Feb. 22, 2004 (DE) ..... 10 2004 008 348

(51) Int. Cl.
*E05B 15/02* (2006.01)

(52) U.S. Cl. ..... 292/341.16; 292/340

(58) Field of Classification Search ..... 292/340, 292/341, 341.16

See application file for complete search history.

(56) References Cited

U.S. PATENT DOCUMENTS

| | | | | |
|---|---|---|---|---|
| 3,521,921 A | | 7/1970 | Miyazaki et al. | |
| 4,838,591 A | * | 6/1989 | Fuss | 292/341.16 |
| 5,118,150 A | * | 6/1992 | Jarrett | 292/341.16 |
| 5,988,711 A | * | 11/1999 | Toma | 292/341.16 |
| 6,874,830 B2 | * | 4/2005 | Bashford | 292/341.16 |

FOREIGN PATENT DOCUMENTS

| | | |
|---|---|---|
| DE | 1772882 | 8/1958 |
| DE | 2853027 | 12/1978 |
| DE | 4418863 | 5/1994 |
| DE | 197 07 759 | 8/1998 |
| EP | 0 851 077 | 7/1998 |

* cited by examiner

*Primary Examiner*—Gary Estremsky
(74) *Attorney, Agent, or Firm*—Baker & Hostetler LLP

(57) ABSTRACT

The invention concerns a locking/unlocking device for a swivel latch of a door opener with a locking lever, that locks or unlocks the swivel latch, and a safety lock that holds the locking lever in a locking position and can be swiveled with the help of an electromagnet in a position unlocking the locking lever, wherein the safety lever is positioned in its center of gravity. Thus only one safety lever is required for the impact safety of the door opener, the susceptibility to shocks and vibrations can be reduced and a space-saving arrangement can be achieved. In a preferred form of execution, the safety lever has two arms wherein the electromagnet is in active connection with one lever arm and a compression spring is in active connection with the other lever arm. The assembly of the device is position-independent.

9 Claims, 3 Drawing Sheets

LOCKING/UNLOCKING DEVICE FOR A DOOR OPENER SWIVEL LATCH

CROSS REFERENCE TO RELATED APPLICATIONS

Figure 1:
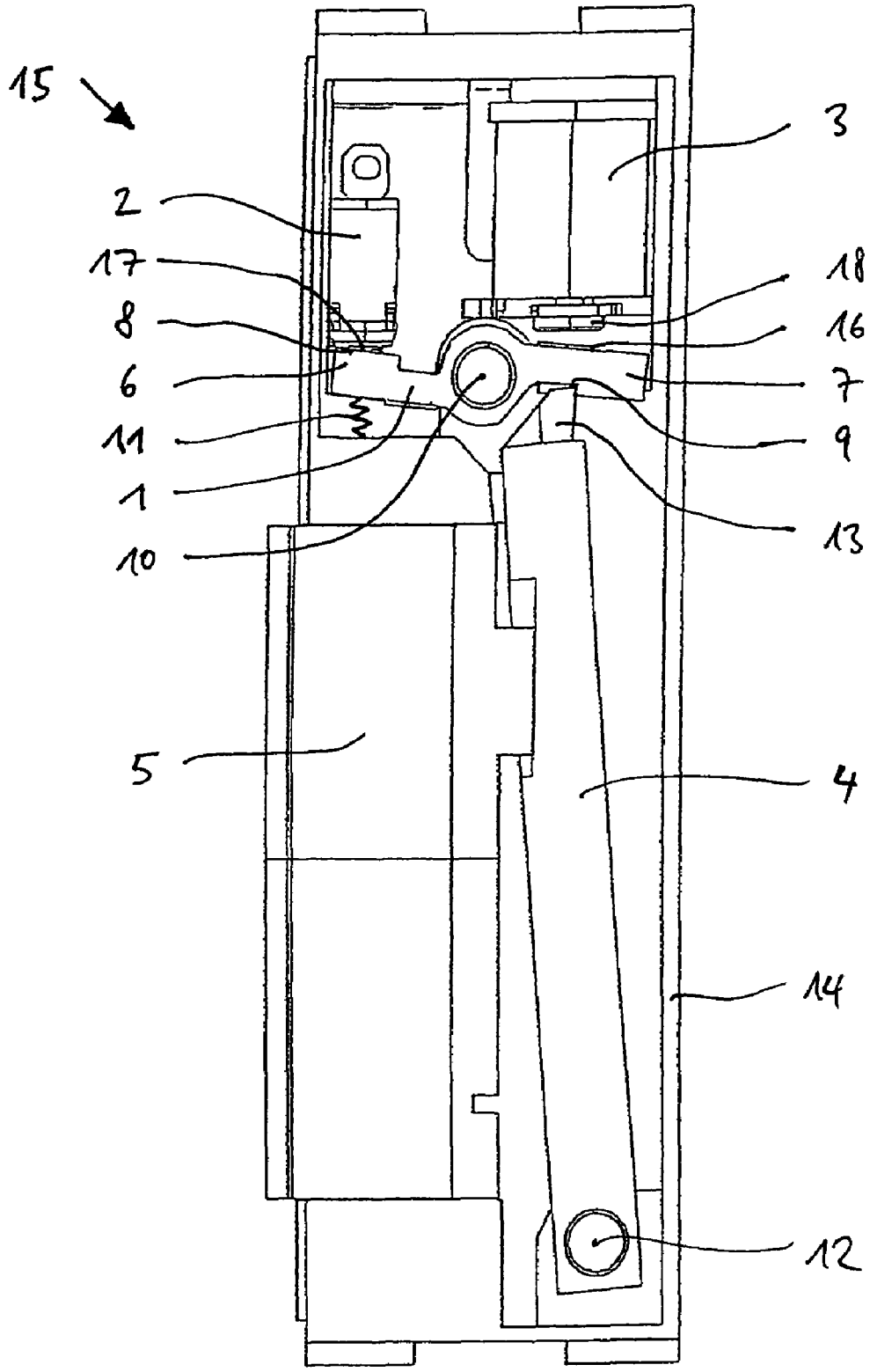

This application claims priority to International Application No. PCT/EP2004/010355, filed Sep. 15, 2004, titled LOCKING/UNLOCKING DEVICE FOR DOOR OPENER SWIVEL LATCH, which claims priority to German Patent Application No. 102004008348.7 filed Feb. 22, 2004, entitled LOCKING/UNLOCKING DEVICE FOR DOOR OPENER SWIVEL LATCH, the disclosure of both applications are incorporated herein by reference in their entirety.

FIELD OF THE INVENTION

The invention concerns a locking/unlocking device for a swivel latch of a door opener with a locking lever that locks or unlocks the swivel latch, and a safety lever that holds the locking lever in a locking position. With the help of an electromagnet, the safety lever is swivelable into a position that releases the locking lever.

BACKGROUND OF THE INVENTION

Generally in such electric door openers the unlocking and/or locking position of the swivel latch is determined by the position of the locking lever. When current is applied to the electromagnet, the safety lever holding the locking lever is activated and adjusted such that it unlocks the locking lever and thus unlocks the swivel latch. Furthermore, as an additional measure it is known to secure the safety lever with a second safety lever that is uncoupled from the above-mentioned safety lever in order to avoid an unwanted adjustment of the first safety lever into an unlocking position of the swivel latch and/or of the locking lever.

DE 19707759 C1 describes a locking/unlocking device with an arrangement of two aforesaid safety levers, wherein the second safety lever secures the first safety lever. An electromagnet is provided for controlling both the safety levers. The second safety lever that is mechanically uncoupled from the first one is in active connection with one end of the electromagnet by magnetic coupling and can be adjusted from a position locking the first safety lever into a position unlocking the safety lever. A pin that is extendable from the coil body of the electromagnet is provided at the other end of the electromagnet for the adjustment of the first safety lock. When current is applied to the coil of the electromagnet, the coil core is magnetized and drawn into the coil and thereby the second safety lever magnetically coupled to it swivels. At the same time the coil pin at the other end of the coil is moved out of the coil and this leads to a swiveling of the first safety lever into the unlocking position. The door opener is in an unlocking position if the first arm of the first safety lever is no longer in mesh with the locking lever and a torsion of the prestressed locking lever can take place as a result. In order to enable the return of both the safety levers to their locking position after current is no longer applied to the electromagnet, compression springs are provided between the housing wall of the door opener and one of the arms of each safety lever.

This and other known locking/unlocking devices with impact safety have many, partly filigree components that are expensive to manufacture and install.

SUMMARY OF THE INVENTION

The task underlying the invention is to create a locking/unlocking device for a swivel latch that requires a simple construction for impact safety of the door opener, apart from efficient manufacturing and installation.

The task is solved by the fact that the safety lever is pivoted at its center of gravity. Thus the swiveling axis lies in the center of gravity. Consequently, no further safety lever is required for guaranteeing the impact safety of the door opener. This precaution guarantees that the safety lever cannot be moved by an impact effect.

Therefore during an external impact on the housing, no effective momentum is exerted on the safety lever that could cause a movement.

In a preferred and advantageous form of execution, the safety lever is swivelable parallel or vertical to the swiveling axis of the swivel latch. The alignment and arrangement of the safety lever can thus be selected according to the installation position of the door opener.

Furthermore, it is advantageous that the safety lever is configured symmetrically. This simplifies the counterbalance of the safety lever. However, an asymmetrical configuration is also thinkable, wherein the counterbalance is achieved by means of the materials in use for the ranges of the safety lever. This may be required in constricted space conditions.

In a preferred form of execution, the safety lever has two lever arms and the electromagnet is in active connection with the one lever arm and a compression spring is in active connection with the other lever arm. For the release of the locking lever it is necessary that the active connection between the electromagnet and one lever arm is greater then the active connection between the preload and the other lever arm. The other arm of the safety lever is actuated with a preload for the return of the safety lever from a position unlocking the locking lever. For example, the force exerted on this lever arm due to a compression spring causes a rotation of the safety lever around the swiveling axis lying between the two lever arms in the center of gravity of the safety lever. The torsional impact produced from the preload is fundamentally smaller than the torsional impact from the active connection between the electromagnet and the safety lever.

In the configuration of the safety lever, it is advantageous that the first and the second lever arms are aligned in one, essentially linear direction. The alignment of the lever arms is essentially dependent on the adjustment of the electromagnet. Thus the safety lever and/or the electromagnet can be adjusted vertically and also horizontally.

In relation to the electromagnet and the space conditions in the housing of the door opener, a transposed adjustment of the lever arms is also possible.

In relation to the monitoring of the state of the safety lever it proves to be advantageous that a microswitch is assigned to the safety lever. Hereby it is convenient that the microswitch is assigned to the lever arm that is actuated with the compression spring. It is advantageous to arrange the microswitch and the compression spring on opposite sides of the lever arm. On the basis of the acting spring tension the lever arm then activates the switch contact or when current is applied to the electromagnet, diverges from the switch contact, wherein the changes in state in each case are detected by the microswitch.

BRIEF DESCRIPTION

Figure 2:
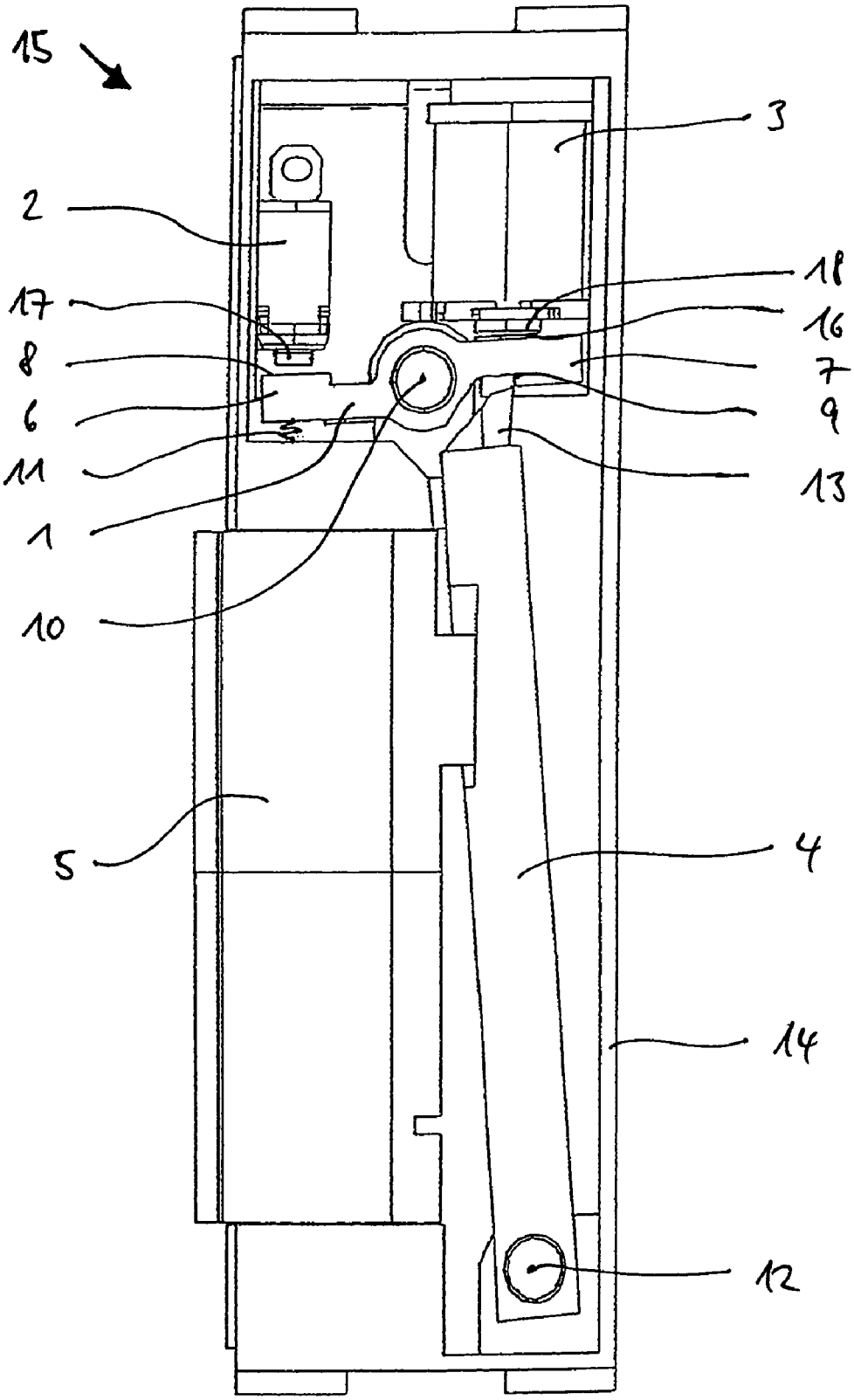
Figure 3:
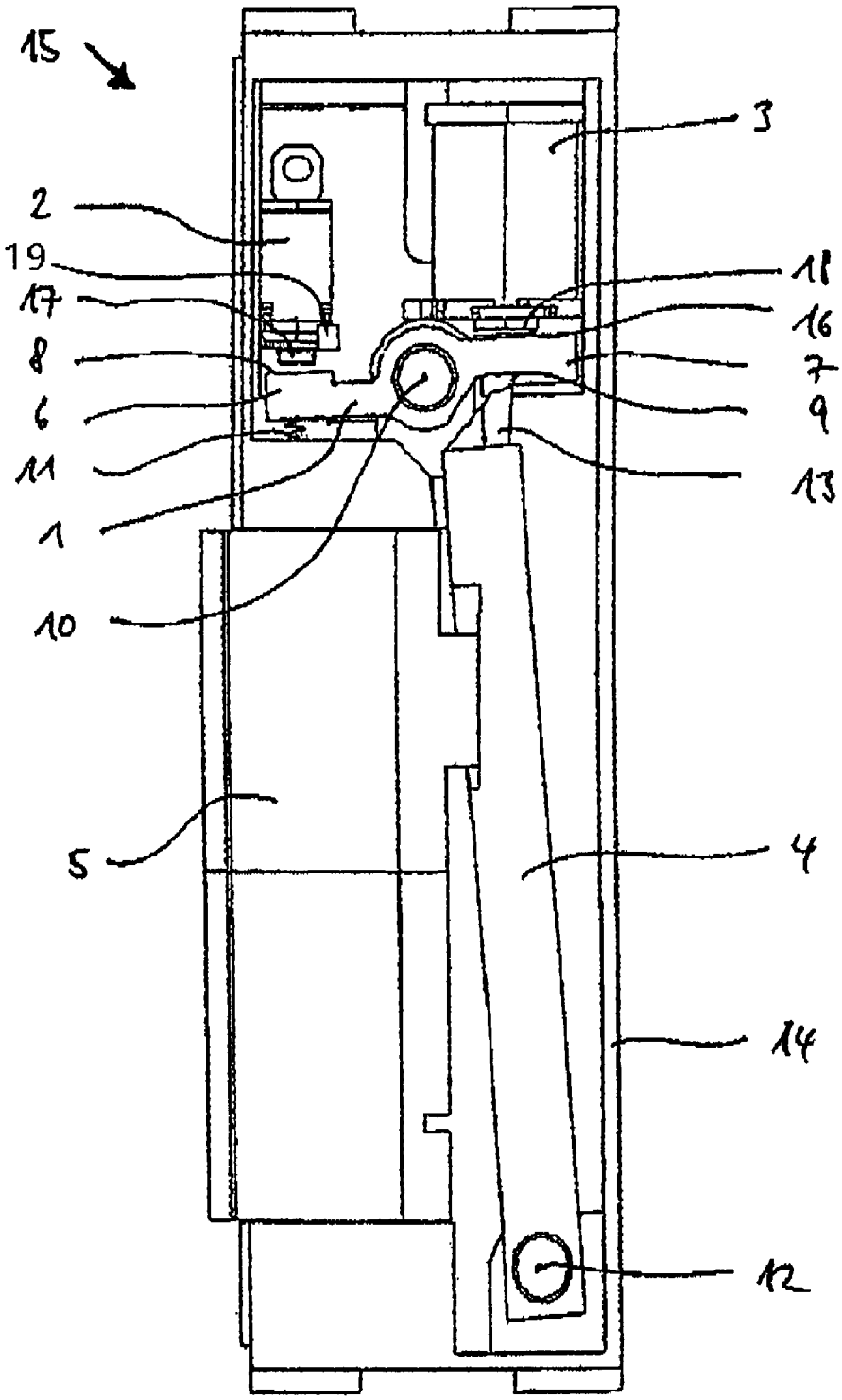

Consequently the invention is further explained on the basis of a preferred form of execution with reference to the figures. It shows schematically:

FIG. 1 a side-view of a locking/unlocking device in a locking position;

FIG. 2 the locking/unlocking device according to FIG. 1 in an unlocking position; and FIG. 3 a permanent magnet in the locking/unlocking device of FIG. 2.

FIG. 1 shows the side-view of a locking/unlocking device (with the housing cover taken off) of a door opener 15 in locking position with a swivel latch 5, a locking lever 4, a safety lever 1 and also an electromagnet 3, that is in active connection with the safety lever 1. FIG. 1 illustrates the locking position of the locking lever 4 and thus the locking position of the swivel latch 5. In this locking position, the door opener is in an impact safe position, i.e. an opening of the door opener for instance by accidental, undirected impact of shocks, vibrations or excessive force is not possible.

The locking lever 4 prevents the swivel latch 5 in the locking position illustrated in FIG. 1 from being transposed into the unlocking position (not illustrated). The locking lever 4 is configured as one piece and is pivoted such that it can swivel around an axis 12.

In order for the locking lever to be brought back from the unlocking position into the locking position, it is actuated by means of a pressure spring with a preload (not illustrated). A notch 13 is configured at the end of the locking lever 4 that is averted from the swiveling axis 12 to enable a mesh with the safety lever 1.

The safety lever 1 essentially aligned crosswise (or vertical) to the locking lever 4 is pivoted such that it can swivel around a centrally adjusted swiveling axis 10 in its center of gravity. Furthermore, it is configured symmetrically and as one piece. The safety lever 1 has two arms 6 and 7 that are arranged in one essentially linear direction parallel to each other and with an easy deviation from each other. A compression spring 11 is present on the side of the first lever arm 6 directed toward the swivel latch 5. This compression spring 11 actuates the first lever arm 6 and thus the safety lock 1 with a preload. This compression spring 11 serves for the return of the safety lever 1 from the unlocking position of the locking lever 4 into the locking position. The second lever arm 7 located on the opposite side of the first lever arm 6 and next to the locking lever 4 has a metallic and/or magnetic counterpart 16 on the side face directed to the electromagnet 3. On the opposite side face of the second lever arm 7 exists a locking lip 9 that runs linearly sectionwise and right-angled to lever arm 7. In the locking position of the safety lever 1, the notch 13 of the locking lever 4 goes for the locking lip 9 of the second arm 7 of the safety lever 1 such that the locking lever 4 cannot be twisted into the unlocking position. The locking lip 9 can also be designed in the form of a groove.

Furthermore FIG. 1 shows a microswitch 2 with a switch contact 17 for the surveillance of the position of the safety lever 1 and/or of the lever arm 6. In case of a transition into the locking position, this microswitch 2 activates the switch contact 17 by the rotation of the lever arm 6 with its side face 8, which is caused by the compression spring 11, and thus the microswitch 2 detects the locking position. In a transition into the unlocking position, the side face 8 of the lever arm 6 accordingly moves away from the switch contact 17 and unlocks it. The microswitch 2 also detects this change in state. The microswitch 2 is essentially aligned parallel to the electromagnet 3, whereby both are arranged vertically and above the safety lever 1 on the housing 14. The direction of action of the electromagnet 3 runs essentially vertical to the arms 6 and 7 of the safety lever 1. The electromagnet 3 consists of a coil body. In addition, the electromagnet 3 has an impact contact 18, on which the counterpart 16 of the second lever arm 7 comes to lie.

The force of attraction from the electromagnet 3 on the counterpart 16 of the second lever arm 7 is laid out such that that the active connection between the electromagnet 3 and the second lever arm 7 is greater than the active connection between the compression spring 11 and the lever arm 6 of the safety lever 1. Expressed differently, the torsional impact exercised around the swiveling axis 10 of the safety lever 1 by means of the compression spring 11 is measured such that this is lesser than the active connection between the electromagnet 3 and the lever arm 7.

The locking position illustrated in FIG. 1 shows the door opener 15 in a not inactive or zero current state of the electromagnet 3. Therefore no force of attraction acts from the electromagnet 3 on the lever arm 7 of the safety lever 1. The compression spring 11 exerts a compression force on the lever arm 6 in clockwise direction. This force causes a torsional moment in clockwise direction around the swiveling axis 10 and presses the lever arm 7 against the end of the locking lever 4 next to it. Thus the locking lip 9 of the second lever arm 7 is in mesh with the notch 13 of the locking lever 4 and is secured via the prevailing torsional moment. As a result, the position of the locking lever 4 prevents an unlocking of the swivel latch 5 and with that the opening of the door opener.

In case of an undirected impact on the door opener for instance by means of shocks or impact of force, a dynamic swinging and/or a force is exerted on the housing 14 of the door opener 15 and from there via the locking lever 4 on the safety lever 1, the torsion of the safety lock 1 in anti-clockwise direction from its locking position is prevented due to the position of the safety lever in its center of gravity.

In the following explanation to FIG. 2, the same parts as in FIG. 1 are indicated with the same reference symbols.

FIG. 2 illustrates the side face of the locking/unlocking device (in an unlocking position) as seen in FIG. 1 with the housing taken off. This position unlocking the locking lever 4 and thus the swivel latch 5 is achieved by an adjustment and/or torsion of the safety lock 1 after application of current to the electromagnet 3. For example after activation of a door opener switch current is applied to the electromagnet 3, wherein the electromagnet 3 exerts an attracting force on the counterpart 16 of the second arm 7 of the safety lever 1. This force, as mentioned above, must be measured such that on the one hand it is at least greater than the opposite acting forces in the locking position and on the other hand it should be at least so great that the safety lever 1 is swiveled at least as far around the axis 10 that the notch 13 of the locking lever 4 is no longer in mesh with the locking lip 9 of the second arm 7 of the safety lever 1 and thus is unlocked. As a rule the force of attraction exerted by the electromagnet 3 on the second lever arm 7 is so great that the lever arm is swiveled so far till it rests against the impact contact 18 of the electromagnet 3.

After discontinuance of current to the electromagnet 3 and thus because of the absent action of force from the electromagnet 3 on the second lever arm 7, the first lever arm 6 is wound back as a result of the action of force out of the prestressed compression spring 11 and of the resulting restoring moment into the locking position till the top side 8 of the lever arm 6 activates the switch contact 17 of the microswitch 2. The microswitch then signals the locked position.

Alternately the electromagnet 3 can be prestressed by means of a permanent magnet (not illustrated) magnetically such that its action of force is activated in a state of zero current. In this manner an idle current door opener is obtained.

The vertically aligned door opener in FIGS. 1 and 2 can be assembled position-independently therefore for example also horizontally.

A further form of execution, not illustrated, is to provide a permanent magnet 19, as shown in FIG. 3, that is in active connection with the first lever arm 6. It has the function of a holding magnet, so that the safety lever 1 is held in its locking position when no current is applied to electromagnet 3.

The invention claimed is:

1. Locking/unlocking device for a swivel latch of a door opener comprising:

a locking lever that locks or unlocks the swivel latch;

an electromagnet; and a safety lever that is actuated with a prestress to engage and thereby hold the locking lever in the locking position and also can be swiveled with the help of the electromagnet into a position unlocking the locking lever, wherein the safety lever pivots about its center of gravity.

2. Locking/unlocking device according to claim 1, wherein the safety lever can be swiveled vertical to the swiveling axis of the swivel latch.

3. Locking/unlocking device according to claim 1, wherein the safety lever is configured symmetrically.

4. Locking/unlocking device according to claim 1, wherein the safety lever has two arms and the electromagnet is in active connection with one lever arm and a compression spring is in active connection with the other lever arm.

5. Locking/unlocking device according to claim 4, wherein the first and the second lever arms are aligned in essentially one linear direction.

6. Locking/unlocking device according to claim 1, wherein the safety lever activates a microswitch for monitoring the position of the safety lever.

7. Locking/unlocking device according to claim 6, wherein the lever arm which is actuated with the compression spring activates the microswitch.

8. Locking/unlocking device according to claim 7, wherein the microswitch and the compression spring are arranged on opposite sides of the lever arm.

9. Locking/unlocking device for a swivel latch of a door opener, comprising:

a locking lever that locks or unlocks the swivel latch;

an electromagnet; and a safety lever that is actuated with a pre-stress and thereby holds the locking lever in the locking position and also can be swiveled with the help of the electromagnet into a position unlocking the locking lever, wherein the safety lever pivots about its center of gravity; and a permanent magnet which is in active connection with a first lever arm of the safety lever such that it has the function of a holding magnet, so that the safety lever is retained in a locking position when no current is applied to the electromagnet.

* * * * *